United States Patent [19]

Hellsten et al.

[11] 4,018,696

[45] Apr. 19, 1977

[54] LIQUID DETERGENT COMPOSITION

[75] Inventors: Karl Martin Edvin Hellsten, Odsmal; Birgit Tora Gunvor Karlsson, Stenungsund, both of Sweden

[73] Assignee: Berol Kemi AB, Stenungsund, Sweden

[22] Filed: Nov. 20, 1975

[21] Appl. No.: 633,899

[30] Foreign Application Priority Data

Nov. 25, 1974 Sweden ..... 7414792

[52] U.S. Cl. ..... 252/89 R; 252/135; 252/DIG. 1; 252/DIG. 14

[51] Int. Cl.[2] ..... C11D 3/075; C11D 1/72

[58] Field of Search ..... 252/DIG. 1, DIG. 14, 252/89 R, 135

[56] References Cited

UNITED STATES PATENTS

| | | | |
|---|---|---|---|
| 3,523,902 | 8/1970 | Schmolka | 252/DIG. 1 |
| 3,663,445 | 5/1972 | Augustin et al. | 252/117 |
| 3,869,399 | 3/1975 | Collins | 252/545 X |

*Primary Examiner*—Thomas J. Herbert, Jr.

[57] ABSTRACT

A liquid aqueous detergent composition is provided which contains a surface active portion, and a complexing agent, as well as, if desired, other components customarily included in detergent compositions, characterized in that the surface active portion mainly contains a. 30–70% of a surface active nonionic alkylene oxide adduct having the formula $$RO(A)_xH$$

where R represents a hydrocarbon group of 8–24 carbon atoms, each A represents independently an oxyalkylene group derived from an alkylene oxide with 2–4 carbon atoms, x represents an integer from 5–50, the number of from ethylene oxide derived oxyalkylene groups being at least 60% of the total number of oxyalkylene groups; and b. 30–70% of a surface active phosphoric acid ester having the common formula $$(R'O)_yPO(OM)_{3-y}$$

where R′ is a straight or branched alkyl chain with 9–11 carbon atoms, *y* is an integer of 1 or 2 and M represents a monovalent cation.

5 Claims, No Drawings

LIQUID DETERGENT COMPOSITION

This invention relates to a liquid aqueous detergent composition particularly suitable for automatic dosage in washing machines.

Of all commercial detergents for textiles, more than about 95% are in powder form. However, it is most desirable to find suitable liquid detergents, as these would permit a completely dustless handling as well as a considerably simplified automation when dispensing the detergent into a washing machine.

One of the more difficult problems that exists in formulating liquid detergent compositions is being able to introduce into the same detergent, surface active components with a partly lipophilic character as well as complexing components, generally with a pronounced hydrophilic character. In general, this problem has been solved by using a mixture of water and an organic solvent, or the addition of a so-called hydrotropic agent, or by a combination of both measures.

A good solution of this problem must also take into consideration that the costs of the composition are not to be increased by adding components which are inactive or negative from a cleansing point of view, and that no unnecessary organic components are added, which increase the biological oxygen consumption at the water cleansing.

According to this invention it has been possible to produce a new liquid detergent composition with at least the same good washing effectiveness as now existing commercial powder detergents. In accordance with the invention, the liquid detergent composition can contain only water as a solvent and forms clear isotropic solutions within the temperature interval of 10°–42° C, the solutions showing an unlimited durability.

According to the invention the aqueous liquid detergent composition contains a surface active portion, a complexing agent and if desired, other additives usually included in detergent compositions, such as alkaline salts, coloring substances, corrosion inhibitors, perfume, and optical whitener. The surface active portion mainly contains:

a. 30–70 w.p. of a nonionic surface active alkylene oxide adduct having the formula $$RO(A)_xH$$

where R represents a hydrocarbon group of 8–24 carbon atoms, each A represent independently an oxyalkylene group derived from an alkylene oxide with 2–4 carbon atoms, $x$ is an integer from 5–50, the number of oxyalkylene groups derived from ethylene oxide being at least 60% of the total number of oxyalkylene groups b. 30–70 w.p. of a surface active phosphoric acid ester having the general formula $$(R'O)_yPO(OM)_{3-y}$$

where R′ is a straight or branched alkyl chain with 9–11 carbon atoms, $y$ is an integer 1 or 2 and M represents a monovalent cation. According to the invention, the detergent composition shows a surprisingly good washing effectiveness, that is significantly higher than the effect shown by corresponding detergent compositions without the surface active phosphoric acid ester. The presence of alkyl phosphate according to the invention also gives storage stability and clear solutions. If the said alkyl phosphate is replaced by other alkyl phosphates with a higher or lower number of carbon atoms in the alkyl chain, then a turbid solution is obtained after a short storage, due to the phase separation.

According to the invention preferred nonionic surface active alkylene oxide adducts are those obtained by adding alkylene oxide to a straight or branched saturated or unsaturated aliphatic or cyclic alcohol with 8–20 carbon atoms, or an alkyl phenol or dialkyl phenol with a total of 14–24 carbon atoms. Specific examples of suitable nonionic surface active compounds are adducts between 5–20 mole ethylene oxide per mole decyl alcohol, lauryl alcohol, myristyl alcohol, cetyl alcohol, stearyl alcohol, eicosyl alcohol, oleyl alcohol, cyclooctanol, cyclohexadecanol, octyl phenol, nonyl phenol, dodecyl phenol, hexadecyl phenol, dibutyl phenol, dioctyl phenol and dinonyl phenol.

The phosphoric acid ester according to the invention is a mono-or dialkyl phosphate or a compound of these phosphates. Preferred is monoalkyl phosphate or compounds of mono- and dialkyl-phosphate, where the monoalkyl phosphate is at least 50% by weight. The monovalent cation is preferably an alkali ion such as potassium or sodium ions, but also ammonium and amino ions are suitable. Generally, the surfactant i.e. the amount of the nonionic surface active portion and the ester of the phosphoric acid, represents 0.5–35, preferably 2.0–20% calculated on the weight of the composition. If desired, one can also add within the scope of the invention smaller amounts of other surface active compounds, such as cationic, ampholytic and other anionic and nonionic surface active compounds.

As complexing agents both those of inorganic and organic nature are suitable. The amount of complexing agents is usually 5–35, preferably 10–25% by weight of the composition.

Alkali metal polyphosphates are especially suitable as complexing agents at the preparation of so-called heavy-duty detergents and also suitable in order to improve the properties of the detergent composition in hard water. Such polyphosphates comprise sodium diphosphate, potassium diphosphate, pentasodium triphosphate, sodium triphosphate, pentapotassium triphosphate, tetrasodium and tetrapotassium diphosphate, sodium tetraphosphate, sodium hexamethaphosphate and pentaammonium triphosphate. Due to their buffering properties, alkali metal silicates, alkali metal borates and alkali metal carbonates are used alone or in mixture with polyphosphates. Examples of these are sodium metasilicate, borax and sodium carbonate.

Valuable organic complexing agents are i.a. alkali metal, ammonium and organic amine salts of polyamino carboxylic acids, i.e. mono-, d-, and trisodium salts of nitrilo acetic acid and sodium salts of N-hydroxyethyl ethylene diamine triacetic acid, N-hydroxyethyl imino diacetic acid and diethylene triamine penta acetic acid, salts of oxycarboxylic acids, such as citric acid, oxydiacetic acid and gluconic acid, and salts of unsaturated polycarboxylic acids, such as polymaleic acid, polyitaconic acid, 1,2,3,4 -tetracarboxy cyclopentane, and polyacrylic acid. Similar to the organic complexing agents these compounds are characterized by their ability to form complexes with hardness-forming metal ions in aqueous solutions. Therefore, they are especially valuable when the detergent composition is used in water of normal or high hardness.

Soil-suspending agents may also be added, especially in formulating heavy-duty detergents. Suitable soil-suspending compositions are sodium carboxymethyl cellulose, sodium cellulose sulphate, lower alkyl and hydroxyalkyl cellulose ethers, such as ethylhydroxyethyl cellulose, ethylhydroxypropyl cellulose, hydroxyethyl cellulose, as well as polyvinyl pyrrolidone. Soil-suspending composition is generally used in amounts from about 0.05–5, preferably 0.1–2%, calculated by the weight of the composition.

Other suitable additives are neutral builder salts such as sodium- or potassium sulphate in order to build up or extend the composition, corrosion inhibitors, such as sodium aluminate, sodium zincate, and alkyl poly oxyalkylene phosphate. Other customary components are coloring agents, optical whitener, pigments, perfumes, foam suppressants, stabilizers, protective colloids and biocidal agents.

The following examples intend to further illustrate the invention.

EXAMPLE 1

Nine compositions were formulated by mixing five parts by weight of nonionic surface active compound having the formula $$C_{14-20}\text{—alkyl—O}\ (C_2H_4O)_8H$$

five parts by weight of a sodium alkyl phosphate of which four parts by weight consisted of a phosphate having the formula $$ROPO\ (ONa)_2$$

and one part by weight having the formula $$(RO)_2POONa$$

wherein R has the meaning defined as per the following table, twelve parts by weight of sodium-nitrilotriacetate and 78 parts by weight of water. The nine formulations were then examined, regarding the storage stability at +10° C. The obtained results are shown by the table below.

| Phosphate compound R represents | Appearance of the compound after 12 days at +10° C |
|---|---|
| n-hexyl | turbid |
| 2-ehtylhexyl | turbid |
| n-octyl | turbid |
| n-decyl | clear |
| $C_{9-11}$-alkyl(75% straight-chained 25% 2-methyl- or 2-ethyl-branched alkyl groups) | clear |
| n-dodecyl | turbid |
| n-tetradecyl | turbid |
| n-hexadecyl | turbid |
| $C_{15-18}$alkyl (40% branched alkyl chains 60% straight alkyl chains) | turbid |

The tests show that only alkyl phosphate compounds with 9–11 carbon atoms in the alkyl group in combination with nonionic surface active compounds give clear solution after 10 days storage at +10° C. However, if the alkyl groups of the phosphate compounds contain 8 carbon atoms or lower, or 12 carbon atoms or higher, turbid products are obtained, which indicates that a phase separation has occurred.

EXAMPLE 2

Seven detergent compositions were formulated by mixing five parts by weight of the nonionic surface active compound in accordance with Example 1 with twelve parts by weight of sodium nitriloacetate, five parts by weight of alkyl phosphate mixture according to Example 1, where R is defined in the following Table, and 78 parts by weight of water. For comparison purposes two formulations were prepared without the nonionic surface active compound respectively the alkyl phosphate mixture.

The washing effectiveness of the nine detergents were then tested, using cotton fabric artificially soiled with silicate pigment from Waschereiforschung Krefeld, polyester/cotton fabric from Test fabrics Inc. artificially soiled with silicate pigment, nylon from Test fabrics Inc. artificially soiled with silicate pigment, as well as polyester/cotton fabric soaked in isotope-labeled oleic acid triglyceride (fat). The washing tests were carried out in a Terg-O-Tometer washing machine at a temperature of 60° C during 15 minutes. The water hardness was 0.9 m mole C $Ca^{2+}$ (5° dH) and the detergent concentration 5 grams per liter solution. The results obtained were as per the Table stated below, the washing effectiveness being expressed as percentage of pigmented soil removed, calculated upon the original proportion. The measurements on cotton, polyester/cotton fabric and nylon were done with a photometer while the measurement on polyester/cotton fabric soaked in oleic acid triglyceride was carried out in a liquid scintillation spectrometer.

| Phosphate compound R represents | % of black content removed | | | % of fat removed |
|---|---|---|---|---|
| | cotton fabric | polyester/ cotton fabric | nylon fabric | polyester/ cotton fabric |
| No alkyl phosphate compound | 80.6 | 64.6 | 73.2 | 71.7 |
| n-hexyl | 79.9 | 60.2 | 73.1 | 70.5 |
| 2-ethylhexyl | 80.8 | 63.2 | 72.4 | 74.8 |
| n-octyl | 79.5 | 61.0 | 72.2 | 68.0 |
| n-decyl | 79.3 | 66.2 | 74.4 | 75.4 |
| n-dodecyl | 77.3 | 57.8 | 73.7 | 71.0 |
| n-tetradecyl | 80.0 | 53.4 | 71.6 | 49.7 |
| n-hexadecyl | 80.9 | 54.6 | 71.8 | 41.4 |

-continued

| Phosphate compound R represents | % of black content removed cotton fabric | polyester/ cotton fabric | nylon fabric | % of fat removed polyester/ cotton fabric |
|---|---|---|---|---|
| n-decyl (no nonionic surface active compound) | 48.9 | 12.9 | 8.2 | 33.4 |

It is evident from the Table that the formulation according to the invention shows throughout very good cleaning properties. Especially large differences are found when cleaning polyester/cotton fabric soiled with pigment soil or with fat.

EXAMPLE 3

Two different detergent compositions according to the invention were tested in accordance with the methods in Example 2, as to washing effectiveness. The composition of the detergents and the obtained results are shown by the following Table.

| Detergent | % of black content removed cotton fabric | polyester/ cotton fabric | nylon fabric | % fat removed polyester/ cotton fabric |
|---|---|---|---|---|
| 5% alkylene oxide adduct of 1 mole nonylphenol +10 mole ethylene oxide, 5% n-decyl phosphate according to Ex. 2, 12% $K_5P_3O_{10}$ | 76.0 | 60.1 | 84.3 | 80.6 |
| 5% n-decyl phosphate according to Ex. 2, 12% $K_5P_3O_{10}$, 5% of 1 mole $C_{14-16-20}$ alcohol +(10 mole ethylene oxide and 1.3 mole propylene oxide) | 76.6 | 52.8 | 85.8 | 80.8 |

The obtained washing results show that the washing effectiveness of the detergent compositions according to the invention is good. No phase separation was observed at the storage of the composition during twelve days of +10° C.

In view of the foregoing disclosure, the following is claimed as the inventive and patentable embodiments thereof:

1. A liquid aqueous detergent composition consisting essentially of an amount within the range from about 0.5 to 35% by weight of the composition of a surfactant and an amount within the range from about 10 to about 25% of a complexing agent the surfactant comprising a. an amount within the range from about 30 to about 70% of a surface active nonionic alkylene oxide adduct having the formula $$RO(A)_xH$$

where R represents a hydrocarbon group having from about eight to about twenty four carbon atoms, each A is an oxyalkylene group derived from an alkylene oxide having from about two to about four carbon atoms, x represents the number of A groups and is a number within the range from about 5 to 50 the number of oxyethylene groups being at least 60% of the total number of oxyalkylene groups; and b. from about 30 to about 70% of a surface active phosphoric acid ester having the formula $$(R'O)_yPO(OM)_{3-y}$$

where R' is alkyl having from nine to eleven carbon atoms, $y$ is an integer of 1 or 2 and M is a monovalent cation.

2. A detergent composition according to claim 1, wherein R is selected from the group consisting of aliphatic and cycloaliphatic group having from about eight to about twenty-four carbon atoms and alkyl phenyl and dialkyl phenyl having from about fourteen to about twenty-four carbon atoms.

3. A detergent composition according to claim 1 wherein A represents an oxyethylene group and $x$ is a number within the range from about 5 to about 20.

4. A detergent composition according to claim 1 wherein the phosphoric acid ester to at least 50% by weight is composed of monoalkyl phosphate.

5. A detergent composition according to claim 1 wherein the amount of surfactant is within the range from about 2 to about 20% by weight.

* * * * *